US011131494B2

(12) United States Patent
Sharma et al.

(10) Patent No.: US 11,131,494 B2
(45) Date of Patent: Sep. 28, 2021

(54) ICE-MACHINE ROTATABLE ASSEMBLY AND HOUSING, AN ICE-MACHINE ROTATABLE ASSEMBLY, AN ICE-MACHINE, AND ASSOCIATED METHODS

(71) Applicants: Ram Prakash Sharma, Haryana (IN); Vinay Sharma, Haryana (IN)

(72) Inventors: Ram Prakash Sharma, Haryana (IN); Vinay Sharma, Haryana (IN)

( * ) Notice: Subject to any disclaimer, the term of this patent is extended or adjusted under 35 U.S.C. 154(b) by 190 days.

(21) Appl. No.: 16/463,035

(22) PCT Filed: Feb. 28, 2018

(86) PCT No.: PCT/IB2018/051259
§ 371 (c)(1),
(2) Date: May 22, 2019

(87) PCT Pub. No.: WO2019/135111
PCT Pub. Date: Jul. 11, 2019

(65) Prior Publication Data

US 2021/0108847 A1 Apr. 15, 2021

(30) Foreign Application Priority Data

Jan. 8, 2018 (IN) ..... 201811000825

(51) Int. Cl.
*F25C 5/20* (2018.01)
*F25C 1/12* (2006.01)

(52) U.S. Cl.
CPC . *F25C 5/24* (2018.01); *F25C 1/12* (2013.01)

(58) Field of Classification Search
CPC ..... F25C 5/24; F25C 1/12
USPC ..... 62/344
See application file for complete search history.

(56) References Cited

U.S. PATENT DOCUMENTS 4,142,678 A * 3/1979 Bottum ..... F25B 30/02 237/2 B
4,872,318 A * 10/1989 Klemmensen ..... F25C 1/04 62/137
4,966,015 A * 10/1990 Wessa ..... F25C 1/045 62/347
6,148,624 A * 11/2000 Bishop ..... F25C 5/185 62/137
8,726,686 B2 * 5/2014 Yoon ..... F25C 1/04 62/345
2001/0054295 A1 * 12/2001 Kawasumi ..... F25C 1/045 62/347

(Continued)

*Primary Examiner* — Henry T Crenshaw

(57) ABSTRACT

An ice-machine rotatable assembly and housing, comprising a first side wall defining a first elongate slot extending from an edge of the first side wall, and the rotatable assembly comprising: a rotatable member configured to move liquid toward an ice former mounted with respect to the housing. The rotatable member including a first connecting part towards a first end of the rotatable member; and a first slide plate having a rail and a first side panel extending along a length of the rail of the first slide plate. The rail of the first slide plate being configured to be at least partially received by the first elongate slot, wherein: the first connecting part of the rotatable member is moveable along the elongate slot to position the rotatable member in the installed position. The first slide plate is mountable with its rail at least partially received by the first elongate slot.

20 Claims, 11 Drawing Sheets

(56) References Cited

U.S. PATENT DOCUMENTS

| | | | | |
|---|---|---|---|---|
| 2007/0130982 | A1* | 6/2007 | Wang | F25C 1/08 62/344 |
| 2010/0024463 | A1* | 2/2010 | Park | F25D 25/025 62/340 |
| 2010/0218541 | A1* | 9/2010 | Kim | F25D 23/126 62/340 |
| 2010/0257888 | A1* | 10/2010 | Kang | F25C 5/22 62/340 |

* cited by examiner

ICE-MACHINE ROTATABLE ASSEMBLY AND HOUSING, AN ICE-MACHINE ROTATABLE ASSEMBLY, AN ICE-MACHINE, AND ASSOCIATED METHODS

CROSS REFERENCE TO RELATED APPLICATIONS

This application is a national stage application under 35 U.S.C. § 371 of PCT Application No. PCT/IB2018/051259, filed Feb. 28, 2018, which claims priority of benefit to Indian Patent Application No. 201811000825, filed on Jan. 8, 2018. The contents of the above-identified applications are hereby incorporated by reference in their entirety.

TECHNICAL FIELD

Present disclosure relates to an ice-machine rotatable assembly and housing, an ice-machine rotatable assembly, an ice-machine, and associated maintenance and construction methods.

BACKGROUND OF THE DISCLOSURE

It is known in the art of ice making machines (i.e. ice-machines), in particular relatively high output machines, for example of the type used in commercial establishments, such as bars and restaurants, to use a rotating member to move water on to a refrigerated surface to form ice.

This rotating member is typically mounted to a housing in which the refrigerated surface and the water is located. The rotating member may extend through an outer wall of the housing and may be configured to be mechanically coupled to a drive mechanism to drive rotation of the rotating member. As such, the rotating member is normally rotatably mounted to the housing (e.g. using one or more bearings).

Whilst other apparatus, in other fields, include housings with rotatably mounted members, the constraints and requirements associated with ice-machines are typically very different to such other apparatus. In particular, the ice-machine has to contain water and parts of the machine are generally maintained at a relatively low temperature. In addition, there is a requirement to maintain the cleanliness of the water within the ice-machine to avoid contamination of the ice produced by the machine.

In ice-machines, the rotating member may be, for example, an arm or a plurality of rotating arms. The arm or arms are configured to splash water against a cooled evaporator and ice former (i.e. the refrigerated surface) and may be provided as a rotatable member assembly. This arrangement is advantageous since the water does not have to pass through small openings which might be present in pump-based machines (small openings which can be blocked by particulates in the water).

Therefore this type of apparatus is a more reliable type of ice-machine than the type which pumps water on to the evaporator. This type of apparatus will be referred to herein as a splasher-type machine.

A disadvantage of known splasher-type ice-machines and some other machines with rotatable members is that it is often difficult to remove the rotatable member assembly for cleaning, repair and/or replacement.

The present invention seeks to ameliorate this and other disadvantages.

SUMMARY OF THE DISCLOSURE

In one non-limiting embodiment of the present disclosure, an ice-machine rotatable assembly and housing. The housing includes a first side wall defining a first elongate slot extending from an edge of the first side wall, and the rotatable assembly. Further, a rotatable member is configured to move a liquid toward an ice former mounted with respect to the housing and the rotatable member being configured for rotation with respect to the housing when in an installed position. The rotatable member including a first connecting part towards a first end of the rotatable member and a first slide plate having a rail and a first side panel extending along a length of the rail of the first slide plate. The rail of the first slide plate being configured to be at least partially received by the first elongate slot, wherein, the first connecting part of the rotatable member is moveable along the elongate slot to position the rotatable member in the installed position. The first slide plate is mountable with its rail at least partially received by the first elongate slot and its first side panel covering at least part of the first elongate slot with the rotatable member in the installed position.

In an embodiment of the present disclosure, the first slide plate may have a second side panel extending along a length of the rail of the first slide plate. The second side panel is configured opposing the first side panel of the first slide plate across a width of its rail, such that, with the rotatable member in its installed position, the first side panel and second side panel may be located on opposing sides of the first side wall of the housing.

In an embodiment of the present disclosure, the first side wall may further define a locating formation at an end of the first elongate slot which may be remote from the edge of the first side wall from which the first elongate slot extends, and the locating formation may be configured to receive the first connecting part.

In an embodiment of the present disclosure, the rotatable member may carry one or more bearings configured to be secured with respect to the housing with the rotatable member in the installed position.

In an embodiment of the present disclosure, the rotatable member may carry two bearings which are carried by the rotatable member such that the first side wall is passable therebetween as the rotatable member is moved towards the installed position.

In an embodiment of the present disclosure, the first slide plate may be secured for movement with at least one of the one or more bearings as the rotatable member is moved towards the installed position.

In an embodiment of the present disclosure, the first elongate slot may be inclined downwardly in the housing from the edge of the first side wall.

In an embodiment of the present disclosure, the housing may include a second side wall defining a second elongate slot extending from an edge of the second side wall. The rotatable member may include a second connecting part towards a second end of the rotatable member and the rotatable assembly includes a second slide plate having a rail and a first side panel. The second connecting part of the rotatable member is moveable along the second elongate slot to position the rotatable member in the installed position and the second slide plate is mountable with its rail at least partially received by the second elongate slot and its first side panel covering at least part of the second elongate slot with the rotatable member in the installed position.

In an embodiment of the present disclosure, the second slide plate may have a second side panel extending along a length of the rail of the second slide plate. The second side panel is configured opposing the first side panel of the second slide plate across a width of its rail, such that, with the rotatable member in its installed position, the first side panel and second side panel may be located on opposing sides of the second side wall of the housing. In an embodiment of the present disclosure, the second side wall may further define a locating formation at an end of the second elongate slot which is remote from the edge of the second side wall from which the second elongate slot extends, and the locating formation may be configured to receive the second connecting part.

In an embodiment of the present disclosure, the rotatable member may carry one or more further bearings configured to be secured with respect to the housing with the rotatable member in the installed position.

In an embodiment of the present disclosure, the rotatable member may carry two further bearings which are carried by the rotatable member such that the second side wall is passable therebetween as the rotatable member is moved towards the installed position.

In an embodiment of the present disclosure, the second slide plate may be secured for movement with at least one of the one or more bearings as the rotatable member is moved towards the installed position.

In an embodiment of the present disclosure, the second elongate slot may be inclined downwardly in the housing from the edge of the second side wall.

In another non-limiting embodiment of the present disclosure, an ice former located within the housing relative to the rotatable assembly such that the rotatable assembly is configured to deliver water to the ice former.

In another non-limiting embodiment of the present disclosure, an arm or paddle, a hollow shaft, and a shaft are provided. The arm or paddle is carried by the hollow shaft, the shaft is receivable by the hollow shaft such that rotation of the shaft causes rotation of the hollow shaft and of the arm or paddle, and the shaft is removable from the hollow shaft to permit disassembly and reassembly.

In an embodiment of the present disclosure, the arm or paddle may be mounted to a sleeve which at least partially receives the hollow shaft.

In an embodiment of the present disclosure, the ice-machine rotatable assembly may further include one or more further arms or paddles carried by the hollow shaft.

In another non-limiting embodiment of the present disclosure, an arm or paddle; a shaft; and a connecting part, wherein the connecting part is configured to be removably connected to the shaft to extend the shaft to aid disassembly and reassembly. The arm or paddle is mounted with respect to the shaft such that rotation of the shaft and connecting part causes rotation of the arm or paddle.

In an embodiment of the present disclosure, the connecting part may have one or a female and a male formation and the shaft has the other of a corresponding female and male formation, such that the formations of the shaft and connecting part are configured to engage each other.

In an embodiment of the present disclosure, the ice-machine rotatable assembly may further include a second connecting part configured to be removably connected to the shaft to extend the shaft to aid disassembly and reassembly. The arm or paddle is mounted with respect to the shaft such that rotation of the shaft, connecting part, and the second connecting part causes rotation of the arm or paddle.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The novel features and characteristics of the disclosure are set forth in the appended description. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION

The foregoing has broadly outlined the features and technical advantages of the present disclosure in order that the detailed description of the disclosure that follows may be better understood. Additional features and advantages of the disclosure will be described hereinafter which form the subject of the description of the disclosure. It should also be realized by those skilled in the art that such equivalent methods do not depart from the scope of the disclosure. The novel features which are believed to be characteristic of the disclosure, as to method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

An ice-machine rotatable assembly and housing is disclosed used to produce ice for various application uses. The housing broadly includes a first side wall defining a first elongate slot extending from an edge of the first side wall, and the rotatable assembly. The ice-machine further includes a rotatable member which is configured to move a liquid toward an ice former mounted with respect to the housing (such as a splasher) and the rotatable member being configured for rotation with respect to the housing when in an installed position. The rotatable member includes a first connecting part towards a first end of the rotatable member and a first slide plate having a rail and a first side panel extending along a length of the rail of the first slide plate. The rail of the first slide plate being configured to be at least partially received by the first elongate slot, wherein, the first connecting part of the rotatable member is moveable along the elongate slot to position the rotatable member in the installed position. The first slide plate is mountable with its rail at least partially received by the first elongate slot and its first side panel covering at least part of the first elongate slot with the rotatable member in the installed position.

Figure 1:
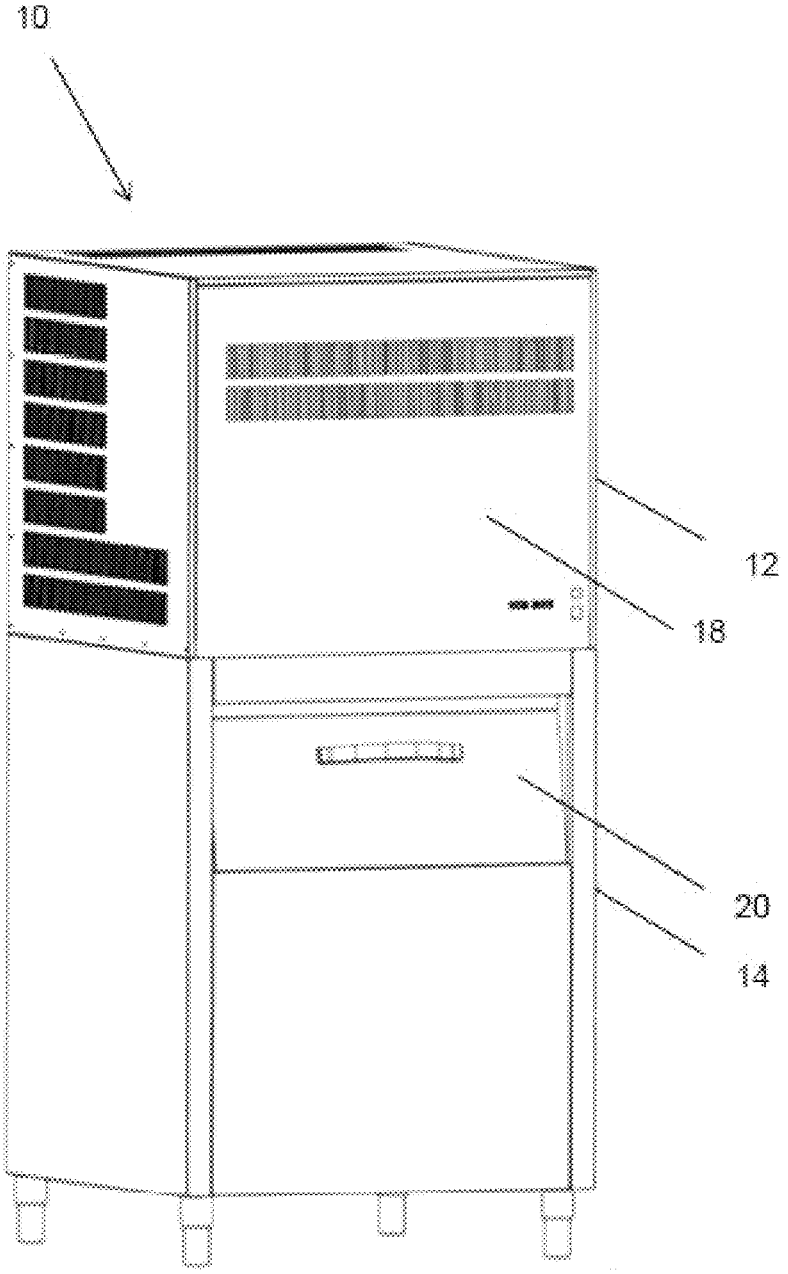
FIG. 1 is an isometric view of the front of an ice-machine.
Figure 10:
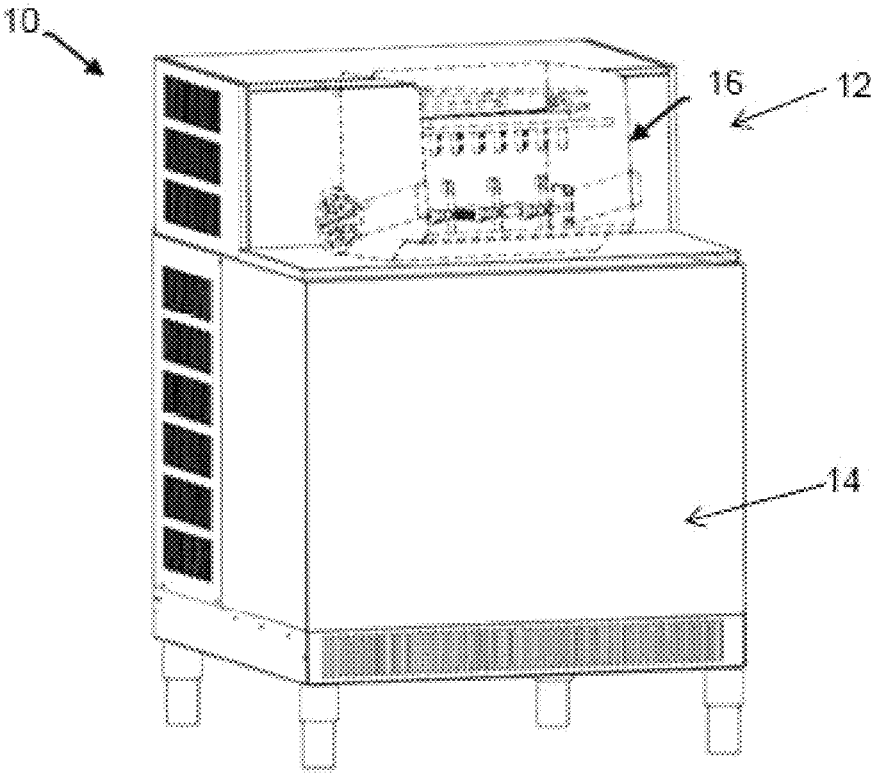
FIG. 10 is an isometric view of the front of an ice-machine.

FIGS. 1 and 10 show examples of a typical splasher-type ice-machine (10) (although it will be appreciated that this could be another type of ice-machine with a rotatable member).

The ice-machine (10) may include an upper portion (12) and a lower portion (14). The upper portion (12) may be the part of the ice-machine (10) which includes the ice-making apparatus. In particular, the ice-making apparatus may include an evaporator assembly (16) (see FIG. 2 for example). The lower portion (14) may include a receptacle or 'bin' for receiving ice which has been made in the evaporator assembly (16). The lower part (14) may include a door (20), which may be openable to access the receptacle, for example to remove ice from the receptacle.

The ice-machine (10) may include a casing (18) which houses the upper and/or lower parts (12, 14) of the ice-machine (10). Parts of the casing (18) may be removable, for example, for maintenance.

An example evaporator assembly (16) is shown in FIGS. 2 to 9, although other configurations are possible in accordance with embodiments.

The evaporator assembly (16) may include a housing (22). The housing (22) may include two side walls (22*a*, 22*b*), and may further include a rear wall (22*c*) and/or a base (22*d*). The two side walls (22*a*, 22*b*) may be substantially parallel to one another and may extend substantially perpendicular to the rear wall (22*c*) and/or the base (22*d*). In some embodiments, therefore, the housing (22) provides five sides of a cuboid. However, it will be appreciated that the housing (22) may be any shape as appropriate. In some embodiments, it is advantageous for the two side walls (22*a*, 22*b*) to be parallel to one another. Each of the two side walls (22*a*, 22*b*) may include an opening which may be in the form of a slot (24). The slot (24) may extend from an edge (such as a front edge) of the respective each of the two side walls (22*a*, 22*b*) and may extend towards the rear wall (22*c*). Each slot (24) may be inclined downwardly from horizontal as it extends away from the edge (e.g. the front edge) of the respective each of the two side walls (22*a*, 22*b*) (e.g. towards the rear wall (22*c*) in some embodiments). Each slot (24) may terminate in a locating formation (26). The locating formation (26) may, for example, be a substantially circular opening and the locating formation (26) may open into the respective slot (24). Each slot (24) may, as will be appreciated, be in the form of an elongate opening and may, therefore, be described as an elongate slot. This elongate slot (24) may extend along a length of the associated each of the two side walls (22*a*, 22*b*) through an entire depth thereof. Each slot (24) may have an open end at the edge of the respective two side walls (22*a*, 22*b*).

The evaporator assembly (16) may include an evaporator plate (28). The evaporator plate (28) may extend across the housing (22) (e.g. between the two side walls (22*a*, 22*b*) and the rear wall (22*c*)). The evaporator plate (28) may divide the housing (22) into an upper part (32) and a lower part (34). The evaporator assembly (16) may include ice formers (30). The ice formers (30) may be temperature controlled, as will be explained in more detail below.

Figure 2:
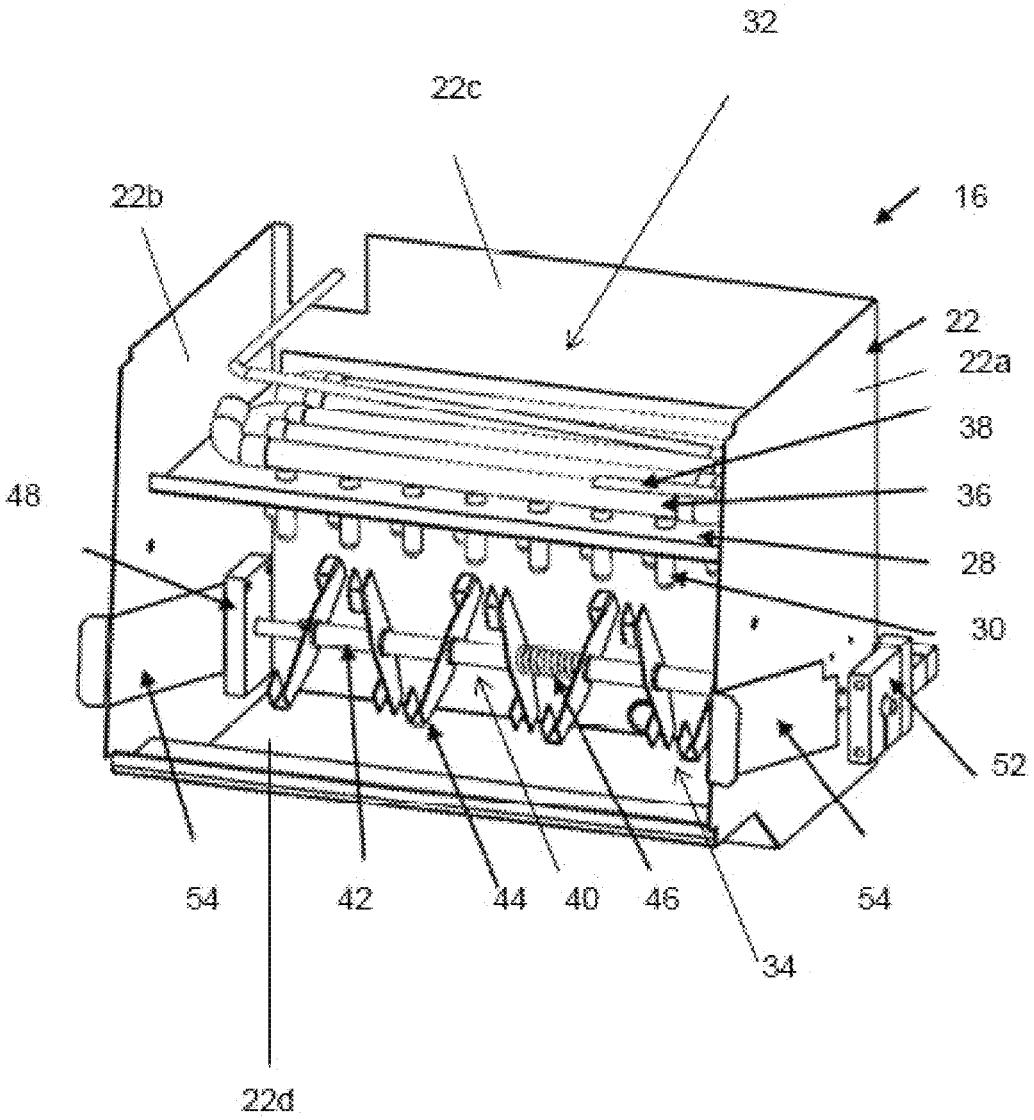
FIG. 2 is an isometric view of an evaporator assembly.
Figure 3:
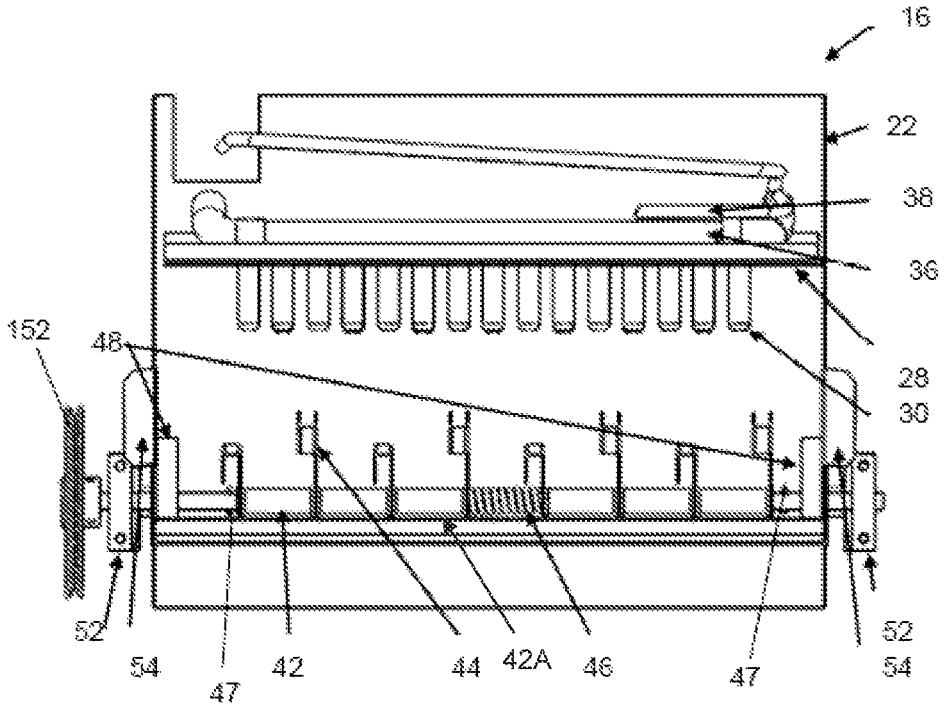
FIG. 3 is a front view of an evaporator assembly.
Figure 4:
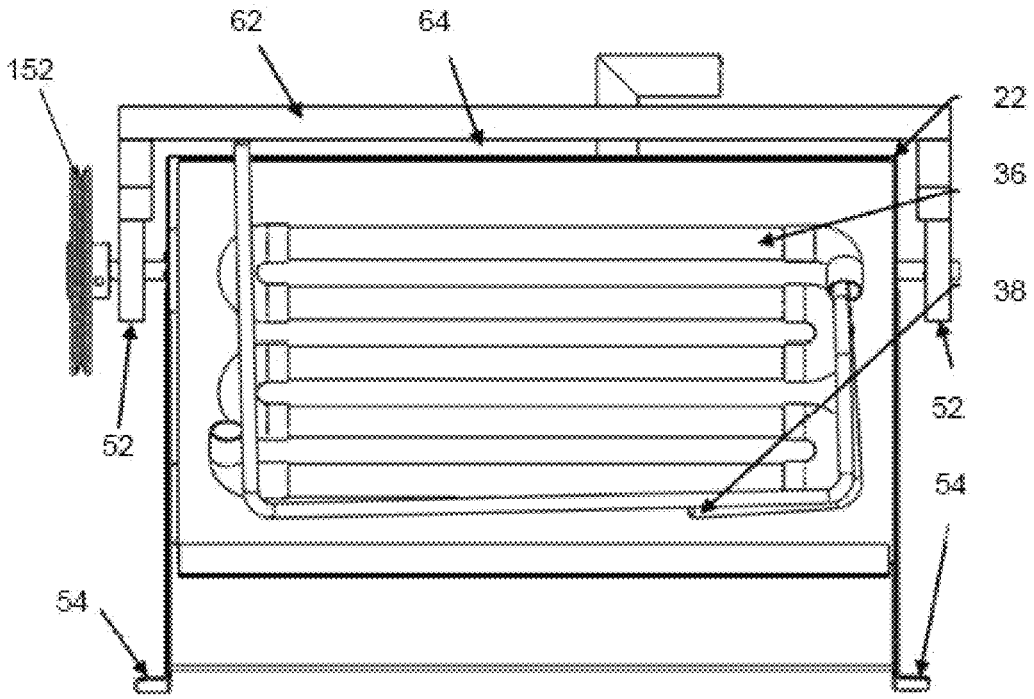
FIG. 4 is a top view of an evaporator assembly.
Figure 7:
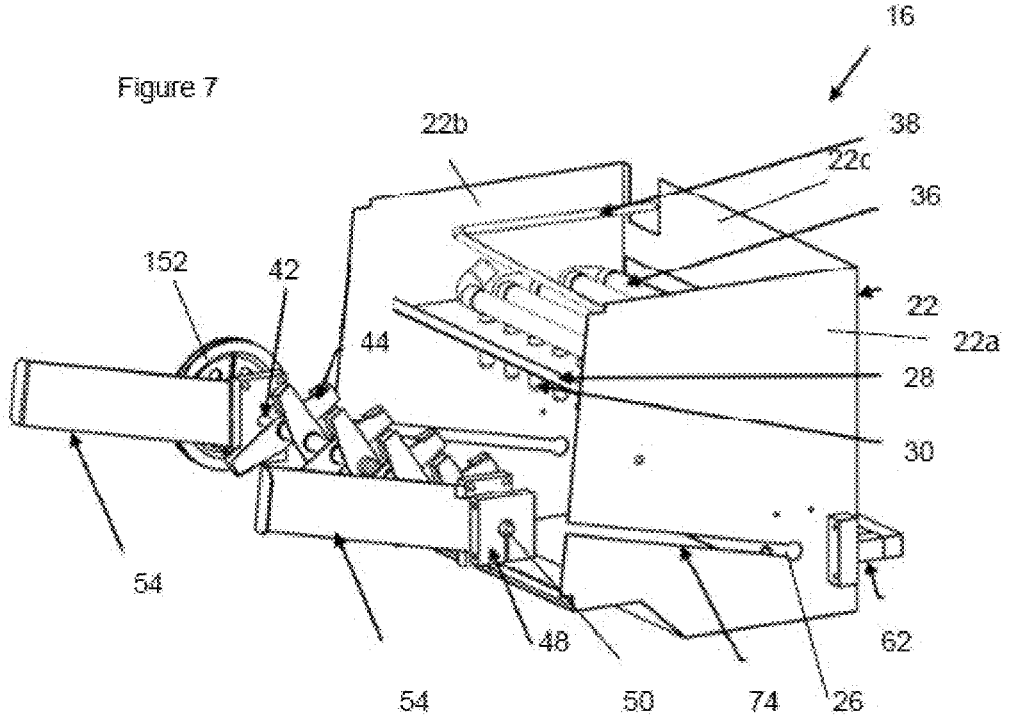
FIG. 7 is an isometric view of an evaporator assembly, showing a splasher assembly removed.

In the examples of FIGS. 2, 3 and 7, the ice formers (30) are shown as being elongate 'fingers', which extend through openings in the evaporator plate (28), from the upper part (32), towards the lower part (34) of the housing (22). However, it will be appreciated that the ice formers (30) may be any shape, as appropriate for the type of ice which is required to be manufactured; for example, the ice formers (30) could be cup-shaped or any other shape which lends itself to forming ice.

The evaporator assembly (16) may include a cooling unit which is configured to cool the evaporator plate (28). The cooling unit may include a tube (36) which is positioned adjacent the evaporator plate (28) (e.g. in the upper part (32) of the housing (22)). The tube (36) may zig-zag back and forth, or may be arranged in any alternative formation, for example a spiral or loop. Temperature controlled fluid, i.e. refrigerant, is able to pass through the tube (36) to control the temperature of the tube (36) (and, therefore, also the evaporator plate (28) and the ice formers (30), if provided). An inlet pipe (38) may also terminate in the upper part (32) of the housing (22). The inlet pipe (38) may be configured to enable fluid, for example water, to be introduced into the upper part (32) of the housing (22). The upper part (32) of the housing (22) may also include a drainage outlet (not shown) configured to enable the fluid to be removed from the upper part (32) of the housing (22).

The evaporator assembly (16) may also include a rotatable member such as a splasher assembly (40). Embodiments are described with reference to the rotatable member being a splasher assembly (40); however, it will be understood that embodiments include the use of other forms of rotatable member—such as an auger. The rotatable member may be configured to move water (e.g. from the bottom of the housing (22)) towards the cooling unit (e.g. the evaporator plate (28) and/or ice formers (30)). Therefore, references to the splasher assembly (40) should be viewed as references to other rotatable members too. Indeed, the rotatable member may be provided as another part of the ice-machine (10). References to the splasher assembly (40) may, therefore, equally be references to a rotatable assembly.

The splasher assembly (40) may include a shaft (42). The shaft (42) may be configured to carry a plurality of arms or paddles (44) which are rotatable with the shaft (42). The plurality of arms or paddles (44) may be attached to the shaft (42) or may be attached to one or more sleeves which are mounted on the shaft (42) (for rotation therewith).

The rotational movement of the shaft (42) (and, therefore, the arms or paddles (44)) may be driven by a motor. The motor may form part of the evaporator assembly (16) or some other part of the ice-machine (10). The motor may be coupled to the shaft (42) via a pulley wheel (152) of the ice-machine (10) which may be mounted at one end of the shaft (42).

In some embodiments, one or more tensioning springs (46) may be provided to space or bias apart adjacent arms or paddles (44) (or the sleeves to which they are mounted) apart with respect to each other along a length of the shaft (42).

In some embodiments, the or each tensioning spring (48) may be a tensioning member which need not be in the form of a spring.

In some embodiments, one or more retaining pins (47) may be provided along a length of the shaft (42). The one or more retaining pins (47) may be positioned towards an end of the shaft (42), for example, the one or more retaining pins (47) may be configured to inhibit or substantially prevent axial movement of the arms or paddles (44) (or the sleeves to which they are mounted) along a length of the shaft (42) beyond the one or more retaining pins (47). This may inhibit or substantially prevent the arms or paddles (44) from contacting the two side walls (22*a*, 22*b*) during operation. In some embodiments, the one or more tensioning springs (46) may bias at least one of the one or more arms or paddles (44) (or the sleeves to which they are mounted) towards the one or more retaining pins (47). In some embodiments, such as those depicted, each of the one or more retaining pins (47) may be located towards opposing ends of the shaft (42). As will be appreciated, therefore, in these and some other embodiments, the or each tensioning spring (46) may be located along the shaft (42) between the one or more retaining pins (47). The or each retaining pin (47) may extend radially away from the shaft (42). In some embodiments, the or each retaining pin (47) may be removable from the shaft (42) to permit dismantling or partial dismantling of the splasher assembly (40).

A connecting part (50) may be provided at each end of the shaft (42). Each connecting part (50) may be an integral part of the shaft (42) or may be a pin separately formed and then secured to the shaft. Each connecting part (50) may be configured to connect the shaft (42) to a respective one of a pair of first bearings (48). The pair of first bearings (48) may be provided as part of the evaporator assembly (16) or the splasher assembly (40) or part of the housing (22), for example.

Each of the first bearings (48) may be located adjacent the respective each of the two side walls (22*a*, 22*b*), and may be located inside the lower part (34) of the housing (22). Each of the first bearings (48) may be removably mountable on the respective each of the two side walls (22*a*, 22*b*) in some embodiments.

Each of the first bearings (48) may be substantially located adjacent to one of the slots (24) and may be located adjacent the respective locating formation (26)—e.g. such that an aperture through the first bearing (48) (which is configured to receive at least part of a respective one of the connecting parts (50)) is generally aligned with a respective locating formation (26).

Each connecting part (50) may also be configured to connect the shaft (42) to a respective one of a second pair of bearings (52). Each of the second bearings (52) may be located outside of the housing (22) (e.g. outside the lower part (34) adjacent respective each of the two side walls (22*a*, 22*b*)). The second pair of bearings (52) may form a part of the evaporator assembly (16) or housing (22), for example.

The second bearings (52) may be mounted on a frame assembly (62) of the housing (22). The frame assembly (62) may attach the second bearings (52) to the housing (22) in order to support the splasher assembly (40).

Each of the second bearings (52) may be substantially located adjacent to one of the slots (24) and may be located adjacent to locating formation (26)—e.g. such that an aperture through the second bearing (52) (which is configured to receive at least part of a respective one of the connecting parts (50)) is generally aligned with a respective locating formation (26).

Accordingly, in some embodiments, each connecting part (50) may be locatable in a respective one of the locating formations (26) and may be locatable through a respective first bearing (48) and/or a respective second bearing (52).

There may be a gap or gaps (64) between parts of the frame assembly (62) and the housing (22). The second bearings (52) may, therefore, be spaced apart from the housing (22) in some embodiments. The housing (22) may be surrounded or partially surrounded with an insulating material. The insulating material may fill or partially fill the gap or gaps (64).

The ice-machine (10) may include a pair of slide plates (54)—which may form part of the evaporator assembly (16) in some embodiments. Each of the pair of slide plates (54) may be moveably positioned between one of the first bearings (48) and one of the second bearings (52)—e.g. adjacent respective each of the two side walls (22*a*, 22*b*) of the housing (22). In some embodiments, each of the pair of slide plates (54) is attached to (and carries) one or both of respective ones of the first and second bearings (48, 52).

Figure 8:
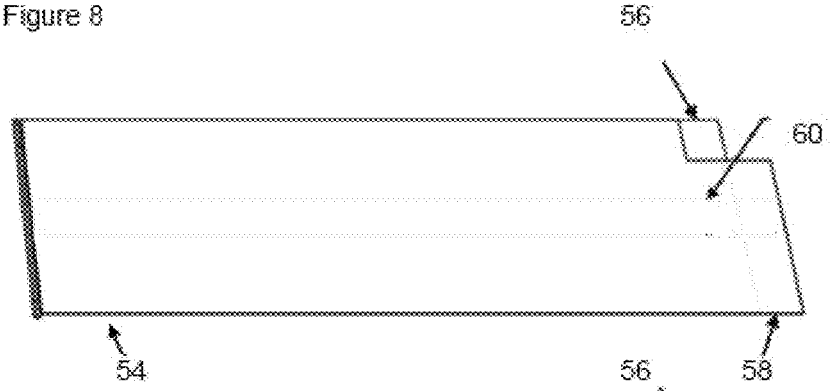
FIG. 8 is a side view of a slide plate.
Figure 9:
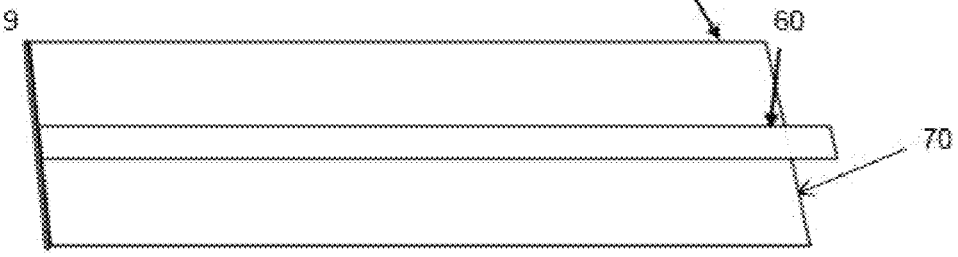
FIG. 9 is a side view of a slide plate with an outer panel removed.

As shown in the examples of FIGS. 8 and 9, each of the pair of slide plates (54) may be a substantially rectangular or trapezoidal in shape.

Each of the pair of slide plates (54) may include an inner panel (56) and an outer panel (58) between which is sandwiched a rail (60). The inner and outer panels (56, 58) may be manufactured from metal, but any appropriate material could be used.

Each rail (60) may be engageable with a respective slot (24). Thus, each of the pair of slide plates (54) may be engageable with respective each of the two side walls (22*a*, 22*b*) of the housing (22), with the inner panel (56) being locatable inside the housing (22) (e.g. between the two side walls (22*a*, 22*b*) and first bearing (48)) and the outer panel (58) being locatable outside the housing (22) (e.g. locatable between the two side walls (22*a*, 22*b*) and the second bearing (52)).

With this in mind, a width of the rail (60) may be generally equal to or greater than a depth of the two side walls (22*a*, 22*b*). The inner and outer panels (56, 58) may have a height which is greater than a height of the slot (24). In some embodiments a length of the outer panel (58) of each of the pair of slide plates (54) may be generally equal to a length of the associated slot (24) from the edge of the two side walls (22*a*, 22*b*) to a proximate edge of the locating formation (26) of that slot (24)—such that the outer panel (58) may cover the slot (24) but allow the connecting part (50) of the shaft (42) to extend through the locating formation (26).

The inner panel (56) and outer panel (58) of the slide plate (54) may be of different lengths in some embodiments. Each rail (60) is moveable along the respective slot (24) which enables each slide plate (54) to move relative to the housing (22). The purpose of the inner and outer panels (56, 58) is to inhibit or substantially prevent the flow of fluid, e.g. water and air, through the slots (24) in the housing (22).

The arrangement of the slots (24) and the design of the slide plates (54) enables the entire splasher assembly (40) to be inserted and removed from the housing (22), whilst inhibiting the leakage of fluid from the housing (22).

Each slide plate (54) may include one or more seals adjacent and/or along and/or around each of the rails (60), to inhibit further the flow of fluid through the slots (24).

As such each slide plate (54) may be moveable between an uninstalled position and an installed position—carrying the splasher assembly (40) with the slide plates (54) and so the splasher assembly (40) is also moveable between installed and uninstalled positions. A part of each slide plate (54) which is located adjacent the edge of the two side walls (22*a*, 22*b*) from which the slit (24) extends may include a handle portion configured to be gripped by a user to enable and/or assist manual movement of the slide plates (54). The handle portion may include a portion of each slide plate (54) which extends generally perpendicular to the inner and outer panels (56, 68) and which may extend inwardly (i.e. the handle portions of a pair of slide plates (54) may extend toward each other when the slide plates (54) are in their installed position).

In some embodiments, the inner panel (56) may not be provided and, in some embodiments, a slide plate (54) is only provided in relation to one (i.e. a single) one of the two side walls (22*a*, 22*b*) (the other side wall, may have a different configuration).

Figure 5:
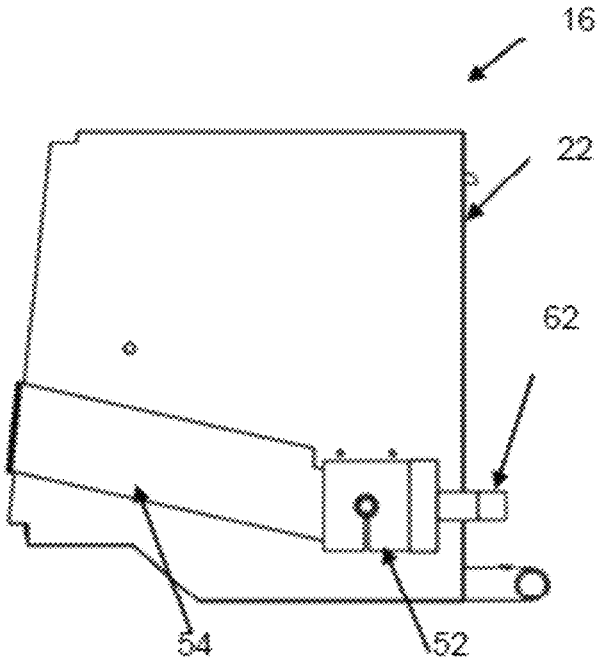
FIG. 5 is a side view of an evaporator assembly.
Figure 6:
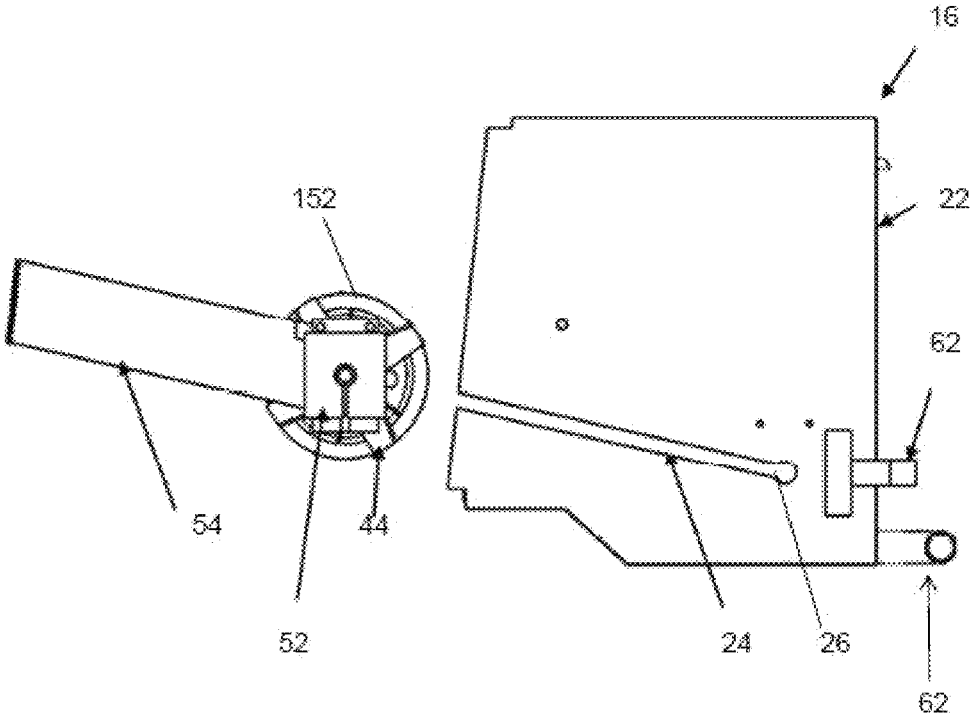
FIG. 6 is a side view of an evaporator assembly, showing a splasher assembly removed.

FIG. 5 is a side view of an example evaporator assembly (16) with the splasher assembly (40) in place, whereas FIGS. 6 and 7 show an example evaporator assembly (16) with the splasher assembly (40) removed revealing the slots (24).

In use, water may be added to the lower part (34) of the housing (22). Water may fill the lower part (34) at least up to the level of the rotatable arms (44). The shaft (42) may then be rotated relative to the housing (22) by the motor, so as to rotate the arms or paddles (44).

The arms or paddles (44) may move, e.g. flick or splash, water on to the ice formers (30) as they rotate. The water stays beneath the evaporator plate (28).

The ice formers (30) may be cooled by the refrigerant in the tube (36), such that water flicked or splashed on to the ice formers (30) freezes, and the ice formers (30) become coated with ice.

Once the ice has reached the desired thickness, rotation of the shaft (42) may stop and warmer fluid may be passed through the tube (36) to warm the ice formers (30). Substantially simultaneously, fluid, e.g. water may be introduced to the upper part (32) of the housing (22) on top of the evaporator plate (28), which warms the evaporator plate. The combination of the warmed ice formers (30) and the warmed evaporator plate (28) may cause the ice to fall off the ice formers (30). The ice may be guided out of the evaporator assembly (16) towards the receptacle in the lower portion (14) of the ice-machine (10), for example by a grating or similar guide member.

Once the ice has dropped from the ice formers (30), which can be detected by the temperature of the refrigerant tube (36), the flow of cold refrigerant through the tube (36) may be resumed, and the motor may cause the shaft (42) and the arms or paddles (44) to rotate, to repeat the ice making process. An advantage of some embodiments is that the splasher assembly (40) can be simply removed from the housing (22), owing to the beneficial arrangement of the evaporator assembly (16), the housing (22), including the slots (24), and the splasher assembly (40), and the slide plates (54).

When the splasher assembly is in its use (installed) position as shown in FIG. 5 for example, each connecting part (50) may be located in the respective one of the locating formations (26). This may enable the splasher assembly (40) to be positively located with respect to the housing (22), so that the splasher assembly (22) is not easily inadvertently displaced relative to the housing (22), and cannot slide out of the housing (22) without the connecting parts (50) being dislodged from the respective locating formations (26). The slide plates (54) may act to seal the slots (24) in the two side walls (22*a*, 22*b*) when the splasher assembly (40) is in its use position.

In some embodiments, the splasher assembly (40) may be removeable from its use (installed) position quickly and easily, without the requirement to dismantle the evaporator assembly (16), and without having to dismantle the housing (22) or the splasher assembly (40) itself. The splasher assembly (40) may be removed from the housing (22) and separated from the evaporator assembly (16) by sliding the slide plates (54) along the respective slots (24). The first bearings (48) may be detached from the housing (22) and the second bearings may be detached from the frame assembly (62). The splasher assembly (40) may then be disconnected from the housing (22) and the evaporator assembly (16) and can be removed by pulling the splasher assembly (40) out along the slots (24). Reattachment of the splasher assembly (40) may be accomplished by reversing this process.

Figure 11:
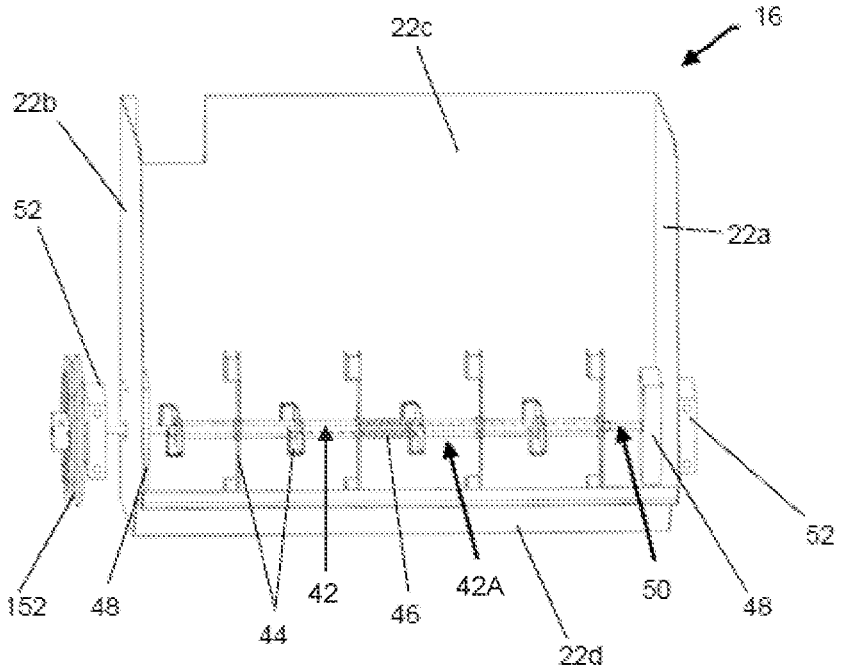
FIG. 11 is a front view of an evaporator assembly.
Figure 12:
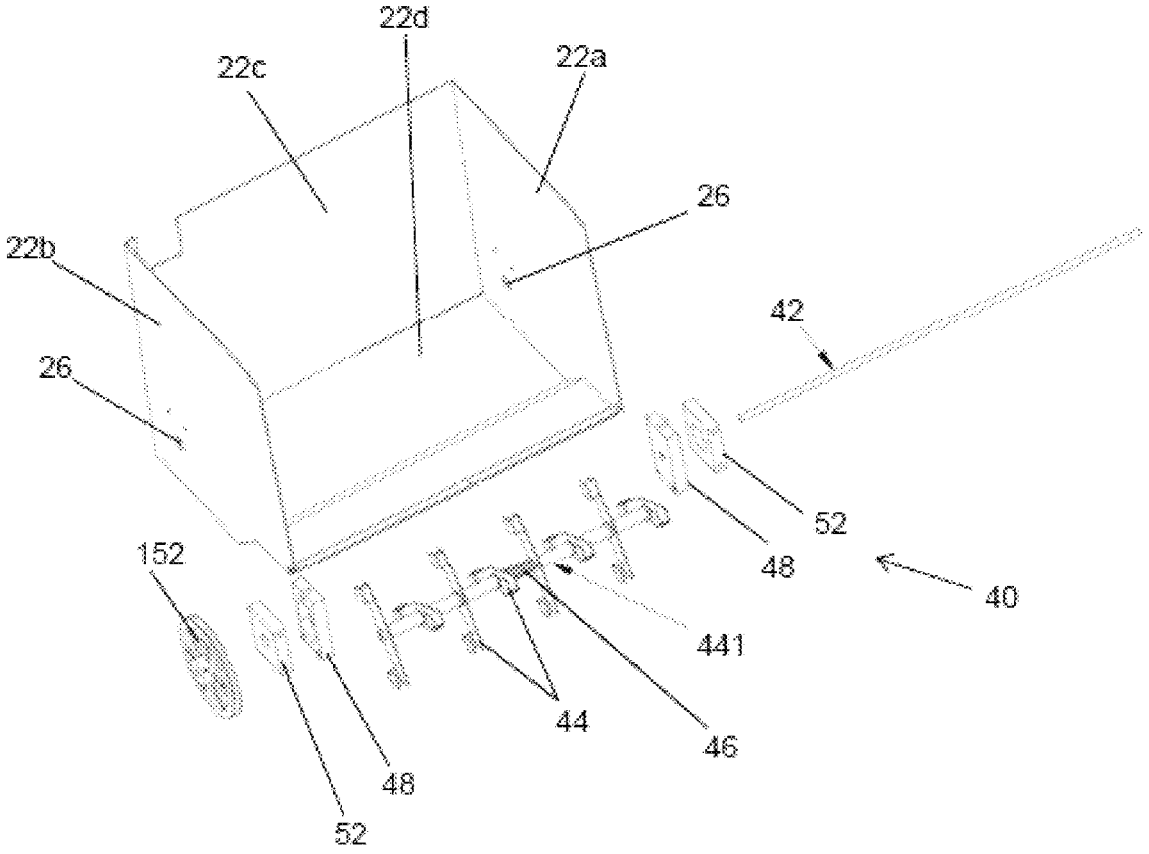
FIG. 12 is an exploded isometric view of an evaporator assembly.

A further embodiment of the evaporator assembly (16) is shown in FIGS. 11 and 12. In this and some other embodiments, the housing (22) is generally of the same construction as described herein except that, in this embodiment no slot (24) is provided. However, the locating formations (26) are provided (e.g. as an aperture through each of the respective two side walls (22*a*, 22*b*)).

Figure 13:
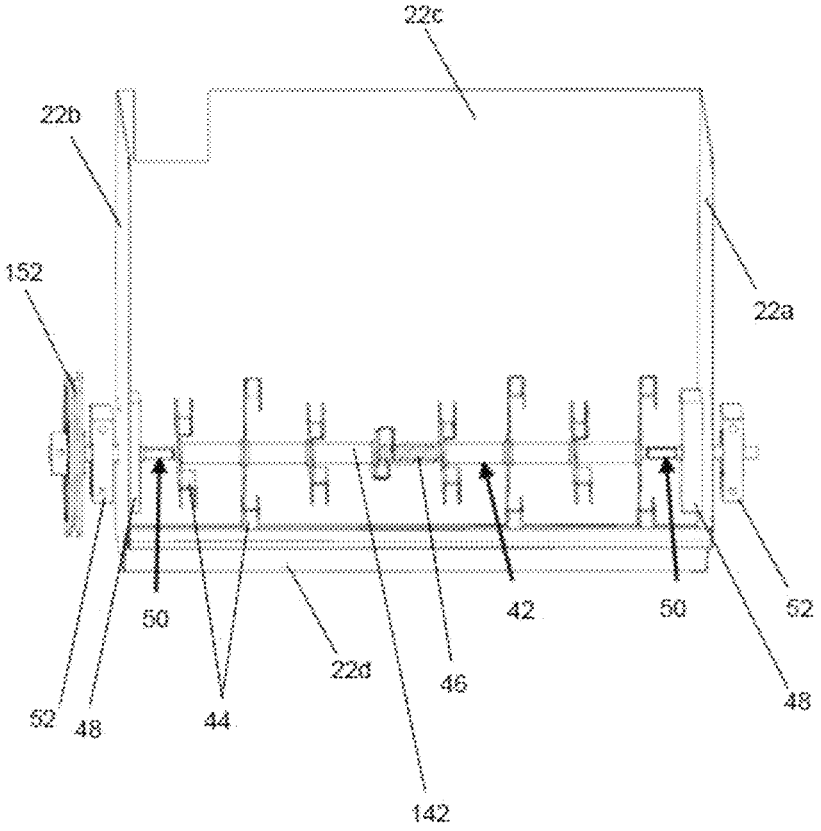
FIG. 13 is a front view of an evaporator assembly.
Figure 14:
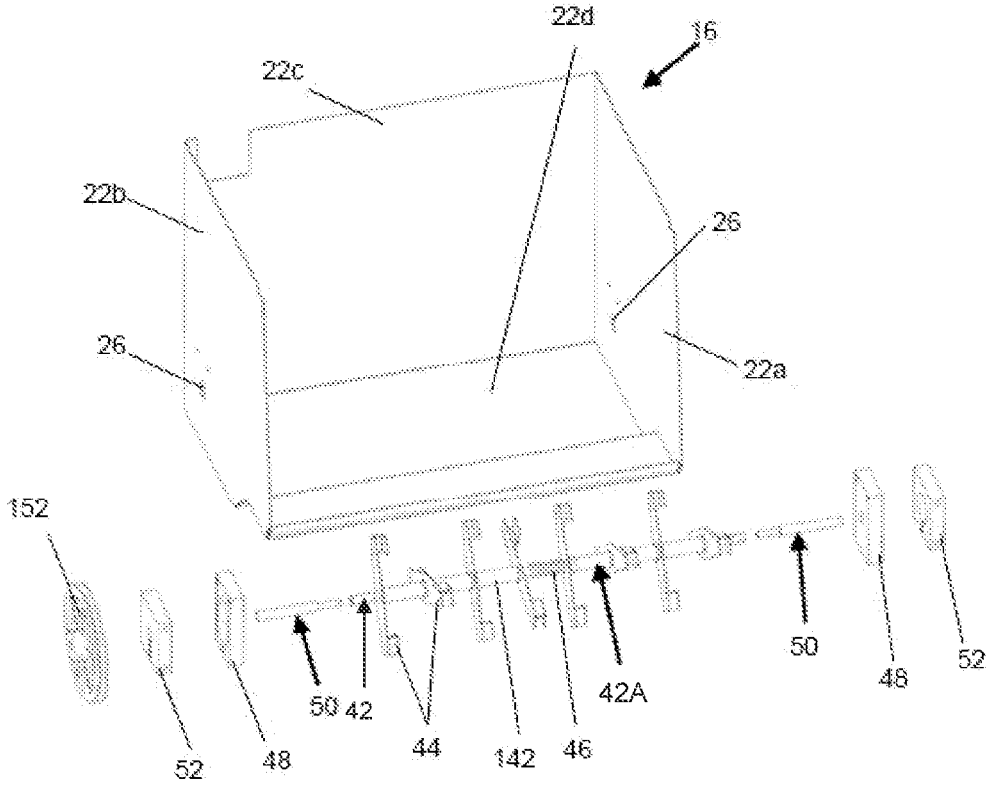
FIG. 14 is an exploded isometric view of an evaporator assembly.

In this and some other embodiments, the splasher assembly (40) includes one or more arms or paddles (44) mounted on a sleeve (441). In some embodiments, the one or more arms or paddles (44) are mounted on the sleeve (441) and that sleeve (441) is formed from two parts which are, themselves, mounted on a hollow shaft (42A). The tensioning spring or springs (46) may be provided between the two parts of the sleeve (441) and may be mounted on the hollow shaft (42A). The hollow shaft (42A) may include stop elements which function in a similar manner to the retaining pins (47) described herein—to limit the movement of the sleeve portions off the hollow shaft. The sleeve (441) (and/or hollow shaft (42A) where provided) may be configured to receive the shaft (42) therethrough. The shaft (42) (e.g. the connecting parts (50)) may be configured to be received by the first and second bearings (48, 52) and the locating formations (26)— generally as described in relation to other embodiments. Thus, removal of the splasher assembly (40) may be achieved by removal of the shaft (42) from the sleeve (441) (and/or hollow shaft (42A) where provided). This may include removal of the shaft from at least first bearing (48) and second bearing (52) (if not from both first bearings (48) and both second bearings (52)). Again, this may provide for straightforward removal of the splasher assembly (40). In some such embodiments, the slot (24) and slide plate (54) arrangement described above may be provided in combination with a shaft (42) and sleeve (441) (and hollow shaft (42A) in some cases). The shaft (42) and hollow shaft (42A) and/or the sleeve (441) may be configured (when assembled) such that rotation of the shaft (42) causes rotation of the hollow shaft (42A) and/or the sleeve (441)—which could be achieve through the use of engaging protrusions on the shaft (42) and hollow shaft (42A) and/or sleeve (441) or through the use of keyed apertures, for example. A further embodiment of a splasher assembly (40) is shown in FIGS. 13 and 14. Again, in this and some other embodiments, the housing (22) is generally of the same construction as described herein except that, in this embodiment no slot (24) is provided. However, the locating formations (26) are provided (e.g. as an aperture through each of the respective side walls (22*a*, 22*b*)). The aperture of each of the locating formations (26) may be a closed aperture—i.e. the aperture may not extend to an edge of the two side walls (22*a*, 22*b*) by which it is defined.

In this and some other embodiments (including those described above), the splasher assembly (40) may include one or more arms or paddles (44) mounted on a sleeve (441). In some embodiments, the one or more arms or paddles (44) are mounted on the sleeve (441) and that sleeve (441) is formed from two parts which are, themselves, mounted on a shaft (which may or may not be the hollow shaft). The tensioning spring or springs (46) may be provided between the two parts of the sleeve (441) and may be mounted on the shaft. The shaft may include stop elements which function in a similar manner to the retaining pins (47) described herein to limit the movement of the sleeve portions off the shaft. Each end of the sleeve (441) (or the shaft if provided) may include a male or female formation which is configured to receive or be received by, as the case may be, a respective connecting portion (50) which may be a separate piece or pin in some such embodiments. Accordingly, the connecting portions (50) may include the other of a male and female formation. Although the depicted embodiment includes two connecting portions (50) with male formations (and a sleeve (441) (or shaft) with two female formations), this arrangement might be reversed or one end of the sleeve (441) (or shaft) may have a female formation and the other a male formation (so requiring a connecting portion (50) with a male formation and a connecting portion (50) with a female formation). In some embodiments, this arrangement is only provided at one end of the sleeve (441) (or shaft) and the other end may be integrally formed with its connecting portion. Again, the splasher assembly (40) is mounted as described herein in relation to other embodiments.

These embodiments also seek to allow for easy removal of the splasher assembly from the housing (22).

In some such embodiments, the slot (24) and slide plate (54) arrangement described above may be provided in combination with a sleeve (142) (and shaft).

As will be appreciated, some embodiments include one or more of the same or corresponding elements on opposing sides of the housing (22) and/or evaporator assembly (16) and/or ice-machine (10). Accordingly, these elements may be labelled "first" and "second" elements to aid understanding. For example, there may be provided a first side wall (22*a*) and a second side wall (22*b*), a first slot (24) and a second slot (24), a first slide plate and a second slide plate (54), first and second connecting portions (50), etc. Similarly, the inner and outer panels (56, 58) may be more generally referred to as first and second panels (the first panel being the inner panel (56) and the second panel being the outer panel (58), or vice versa).

Embodiments include methods of maintaining or constructing the apparatus described herein. For example, embodiments include methods of maintaining or constructing an ice-machine (10) rotatable assembly and housing (22), including: providing an ice-machine (10) rotatable assembly and housing (22); and mounting the rotatable member and first slide plate (54) to the housing (22).

Embodiments include methods of maintaining or constructing the apparatus described herein. For example, embodiments include methods of maintaining or constructing an ice-machine (10), including: providing an ice-machine (10) rotatable assembly; providing a housing (22); and mounting the ice-machine (10) rotatable assembly to the housing (22).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms.

For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. An ice-machine comprising a rotatable assembly and a housing, the housing comprising: a first side wall defining a first elongate slot extending from an edge of the first side wall, and the rotatable assembly comprising:

a rotatable member configured to move a liquid toward an ice former mounted with respect to the housing, the rotatable member being configured for rotation with respect to the housing when in an installed position, and the rotatable member including a first connecting part towards a first end of the rotatable member; and a first slide plate having a rail and a first side panel extending along a length of the rail of the first slide plate, and the rail of the first slide plate being configured to be at least partially received by the first elongate slot, wherein, the first connecting part of the rotatable member is moveable along the first elongate slot to position the rotatable member in the installed position, the first slide plate is mountable with the rail of the first slide plate at least partially received by the first elongate slot, and the first side panel covering at least part of the first elongate slot with the rotatable member in the installed position, and a second side panel extending along a length of the rail of the first slide plate, and the second side panel opposing the first side panel of the first slide plate across a width of the rail, such that, with the rotatable member in the installed position, the first side panel and second side panel are located on opposing sides of the first side wall of the housing.

2. The ice-machine according to claim 1, wherein the first side wall further defines a locating formation at an end of the first elongate slot which is remote from the edge of the first side wall from which the first elongate slot extends, and the locating formation is configured to receive the first connecting part.

3. The ice-machine according to claim 1, wherein the rotatable member carries one or more bearings configured to be secured with respect to the housing with the rotatable member in the installed position.

4. The ice-machine according to claim 3, wherein the rotatable member carries the one or more bearings such that the first side wall is passable therebetween as the rotatable member is moved towards the installed position.

5. The ice-machine according to claim 3, wherein the first slide plate is secured for movement with at least one of the one or more bearings as the rotatable member is moved towards the installed position.

6. The ice-machine according to claim 1, wherein the first elongate slot is inclined downwardly in the housing from the edge of the first side wall.

7. The ice-machine according to claim 1, wherein the housing includes a second side wall defining a second elongate slot extending from an edge of the second side wall, and the rotatable member includes a second connecting part towards a second end of the rotatable member and the rotatable assembly includes a second slide plate having a rail and a first side panel, and wherein the second connecting part of the rotatable member is moveable along the second elongate slot to position the rotatable member in the installed position, the second slide plate is mountable with the rail of the second slide plate at least partially received by the second elongate slot, and the first side panel covering at least part of the second elongate slot with the rotatable member in the installed position.

8. The ice-machine according to claim 7, wherein the second slide plate has a second side panel extending along a length of the rail of the second slide plate, and the second side panel opposing the first side panel of the second slide plate across a width of the rail, such that, with the rotatable member in the installed position, the first side panel and second side panel are located on opposing sides of the second side wall of the housing.

9. The ice-machine according to claim 7, wherein the second side wall further defines a locating formation at an end of the second elongate slot which is remote from the edge of the second side wall from which the second elongate slot extends, and the locating formation is configured to receive the second connecting part.

10. The ice-machine according to claim 8, wherein the rotatable member carries one or more bearings configured to be secured with respect to the housing with the rotatable member in the installed position.

11. The ice-machine according to claim 10, wherein the rotatable member carries the one or more bearings such that the second side wall is passable therebetween as the rotatable member is moved towards the installed position.

12. The ice-machine according to claim 10, wherein the second slide plate is secured for movement with at least one of the one or more bearings as the rotatable member is moved towards the installed position.

13. The ice-machine according to claim 7, wherein the second elongate slot is inclined downwardly in the housing from the edge of the second side wall.

14. The ice-machine according to claim 1, wherein the ice former is located within the housing relative to the rotatable assembly such that the rotatable assembly is configured to deliver water to the ice former.

15. The ice-machine according to claim 1, further comprising: an arm or paddle; a hollow shaft; and a shaft, wherein the arm or paddle is carried by the hollow shaft, the shaft is receivable by the hollow shaft such that rotation of the shaft causes rotation of the hollow shaft and of the arm or paddle, and the shaft is removable from the hollow shaft to permit disassembly and reassembly.

16. The ice-machine according to claim 15, wherein the arm or paddle is mounted to a sleeve which at least partially receives the hollow shaft.

17. The ice-machine according to claim 15, further comprising one or more further arms or paddles carried by the hollow shaft.

18. The ice-machine according to claim 15, further comprising: the arm or paddle; the shaft; and a connecting part, wherein the connecting part is configured to be removably connected to the shaft to extend the shaft to aid disassembly and reassembly, and the arm or paddle is mounted with respect to the shaft such that rotation of the shaft and the connecting part causes rotation of the arm or paddle.

19. The ice-machine according to claim 18, wherein the connecting part has one or a female and a male formation and the shaft has the other of a corresponding female and male formation, such that the formations of the shaft and the connecting part are configured to engage each other.

20. The ice-machine according to claim 18, further comprising: a second connecting part configured to be removably connected to the shaft to extend the shaft to aid disassembly and reassembly, and the arm or paddle is mounted with respect to the shaft such that rotation of the shaft, the connecting part, and the second connecting part causes rotation of the arm or paddle.

* * * * *